United States Patent [19]

Zollinger

[11] 3,996,972

[45] Dec. 14, 1976

[54] ARRANGEMENT FOR ACTUATING LAMINAS ON A WAVE-TYPE LOOM

[75] Inventor: Hans Zollinger, Tann-Ruti, Switzerland

[73] Assignee: Ruti Machinery Works Ltd., Ruti, Switzerland

[22] Filed: June 30, 1975

[21] Appl. No.: 591,865

[30] Foreign Application Priority Data

July 6, 1974 Switzerland ..... 9379/74

[52] U.S. Cl. ..... 139/436

[51] Int. Cl.[2] ..... D03D 47/26

[58] Field of Search ..... 139/11, 12, 13, 188, 139/191

[56] References Cited

UNITED STATES PATENTS

| | | | |
|---|---|---|---|
| 3,241,573 | 3/1966 | Fend | 139/12 |
| 3,263,705 | 8/1966 | Rossmann | 139/12 |
| 3,831,638 | 8/1974 | Selivanov et al. | 139/12 |

FOREIGN PATENTS OR APPLICATIONS

| | | | |
|---|---|---|---|
| 240,564 | 4/1960 | Australia | 139/12 |

*Primary Examiner*—Henry S. Jaudon
*Attorney, Agent, or Firm*—Donald D. Denton

[57] ABSTRACT

An arrangement for actuating laminas on a wave-type loom, in which the laminas are held individually by a coupling body which extends over the width of the loom, the driving of the laminas taking place by drive means arranged closely alongside each other over the width of the loom and act on the coupling body and are coupled with drive cams, the drive means being so dimensioned that the part acting on the coupling body is several times the thickness of a lamina.

14 Claims, 7 Drawing Figures

Fig. 2

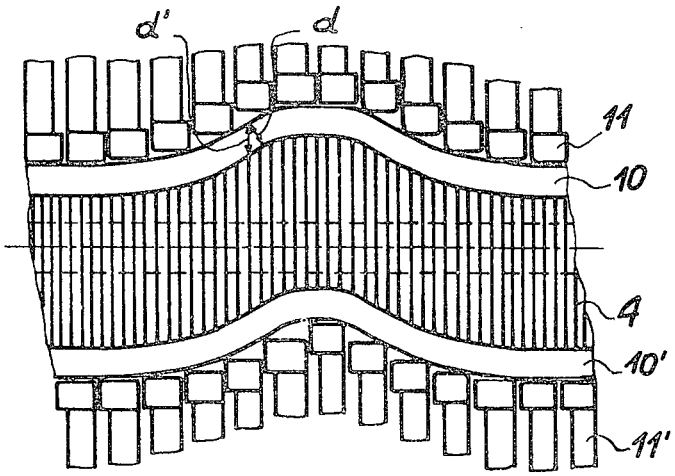
Fig. 4
Fig. 6
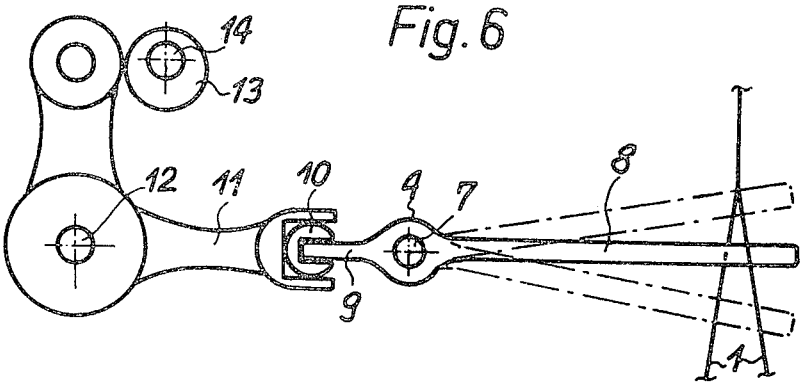
Fig. 7
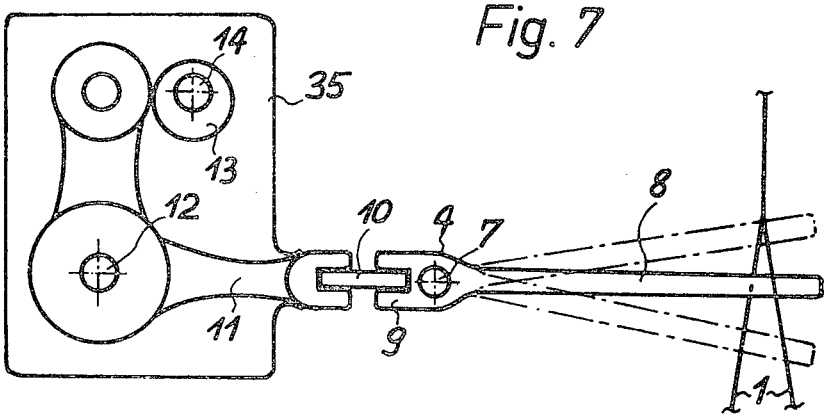

ARRANGEMENT FOR ACTUATING LAMINAS ON A WAVE-TYPE LOOM

BACKGROUND OF THE INVENTION

The present invention relates to an arrangement for actuating laminas on a wave- or undulating-shed-type loom, which laminas extend between the filling threads at the place of the formation of the shed and are arranged alongside each other along a swivel axis over the loom width of the undulating-shed-type loom and in operation carry out in their entirety an undulatory movement in a direction advancing over the width of the loom, the laminas being swingable about the swivel axis by means of drive cams.

Undulating-shed-type looms are known in which the laminas which both drive the shuttles and beat-up the filling thread rest directly on a helical shaft forming one of the drive cams, the so-called screw shaft. Since the laminas are of only very slight thickness, this direct force-fitting contact between laminas and screw shaft leads to a wear of the screw shaft thus reducing its life.

The closest prior art known to applicant in connection with this application is U.S. Pat. No. 3,809,130.

SUMMARY OF THE INVENTION

The present invention avoids the above-described disadvantage and is characterized by the fact that the laminas are held individually by a coupling body of flexible material which extends over the entire width of the loom or weaving machine and that the drive of the laminas takes place by means of drive means which are arranged closely alongside of each other over the width of the machine, act on the coupling body and are coupled with the drive cams, the said drive means being so dimensioned that at the part thereof acting on the coupling body their width is several times the thickness of a lamina.

Due to the fact that not every lamina rests on the corresponding drive cam but only a relatively small number of the drive means as compared with the number of laminas and the thickness of which furthermore is a multiple of the thickness of the drop wires, a considerable reduction in the wear of the drive cam is obtained by a suitable shaping of the drive means at the part thereof coupled with the corresponding drive cam.

The parts of the drive means acting on the coupling body form a step shaped curve. The coupling body snugly fits this step shaped curve and forms in this connection a continuous wave so that the laminas borne by the coupling body also form a continuous wave. In the straight sections of this wave and particularly therefore in that position of swing of the laminas in which the beating up of the filling thread takes place, the coupling body rests snugly against the drive means which makes possible a straight beating edge even with the large forces customary in connection with the beating up of the thread.

A preferred embodiment of the arrangement in accordance with the invention is characterized by the fact that the drive cams are each formed by an eccentric disk associated with each drive means, the eccentric disks being arranged on a common drive shaft which is arranged parallel to the swivel axis of the laminas.

In this embodiment thus the known screw shaft is replaced by a plurality of eccentric disks which are spaced apart from each other. It is obvious that these eccentric disks are substantially simpler to manufacture than a screw shaft.

BRIEF DESCRIPTION OF THE DRAWINGS

These and other objects of the present invention will become apparent from the following description of a preferred embodiment which is described in further detail below on basis of illustrative examples and the drawings, in which:

FIG. 4 shows a basic sketch to explain the operation;

FIGS. 6 and 7 each shows variants of a detail of FIG. 2.

DESCRIPTION OF THE PREFERRED EMBODIMENTS

Figure 1:
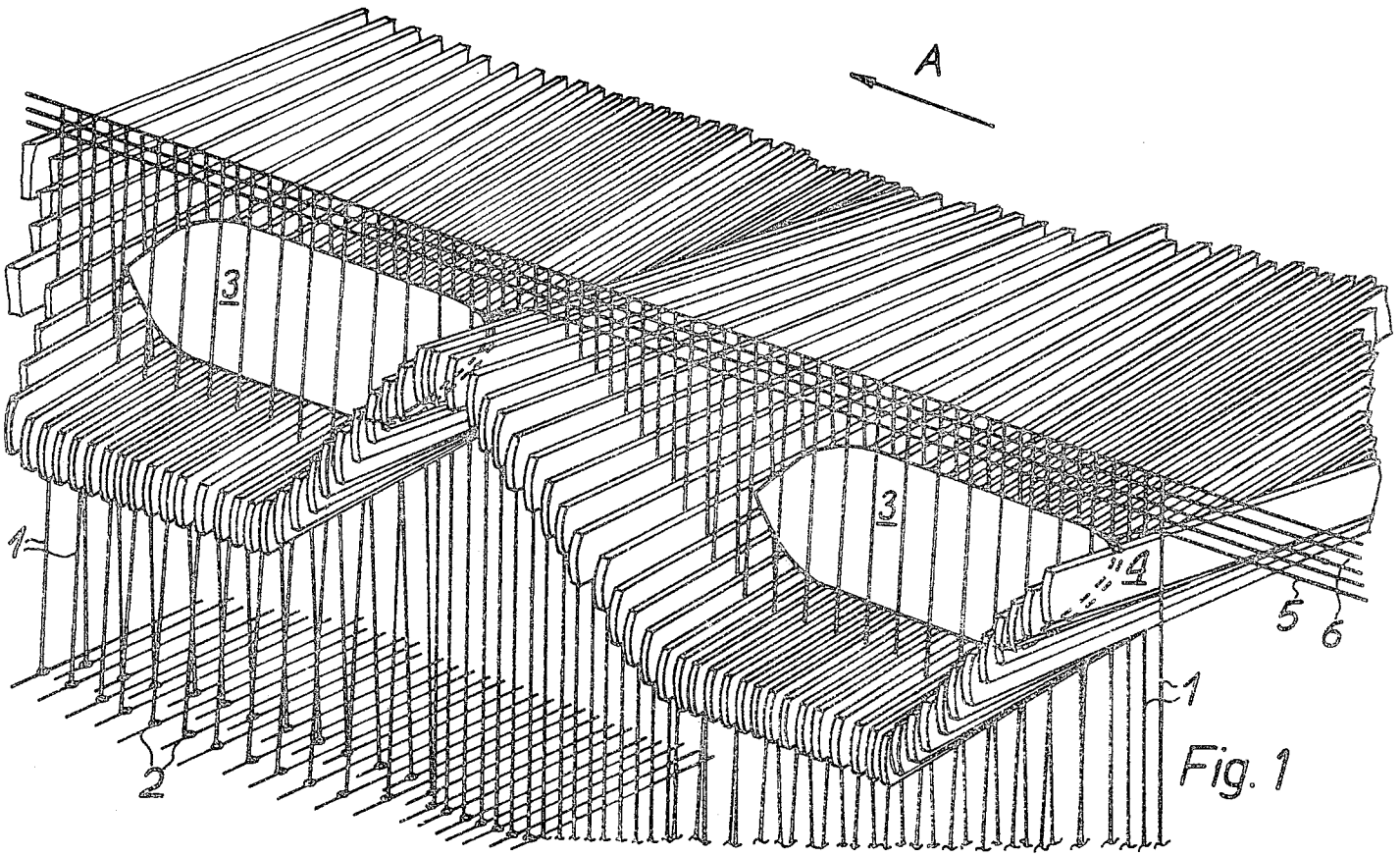
FIG. 1 shows a schematic view of a portion of the shed of an undulated-shed-type loom with the insertion members and the laminas that drive them.

Referring to FIG. 1, warp threads 1, which are moved by heddles 2 and extend towards the fabric beat-up edge, form an open shed at the location of the front part of each insertion member or shuttle 3. Between every two successive shuttles there is a change of shed. The individual sheds move in undulated manner in the direction indicated by the arrow A; the shuttles 3 move together with the sheds in the same direction and each of them inserts a filling thread 5 during its advance. For the sake of convenience in an understanding of the drawing, the warp threads 1 have been shown less close together than is actually the case. The fabric itself is designated by 6.

The forward movement of the shuttle 3 is effected by the laminas 4 acting as filling-thread beat-up members, extending between the warp threads and being pressed from below against the rear oblique edge of the shuttles 3 (as seen in the direction of movement) and thereby move the latter in the direction indicated by the arrow A. At the same time the corresponding filling thread 5 is beaten up against the beat-up edge of the fabric by the lamina 4 which is nearest to the top at the time. The guiding of the shuttles 3 in each web is effected by the warp threads 1.

Figure 2:
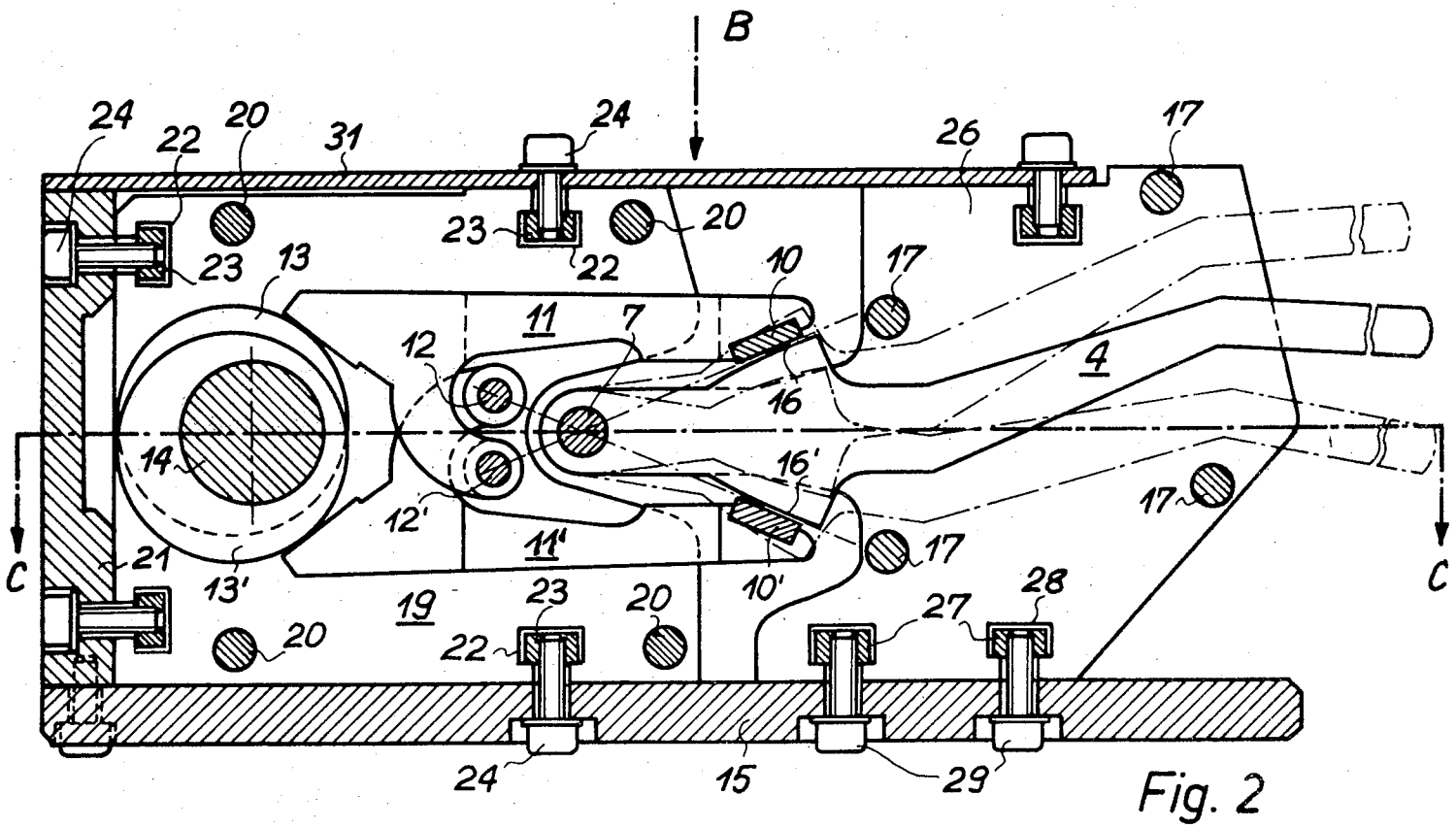
FIG. 2 shows an illustrative embodiment in cross-section of a system in accordance with the invention for actuating of the laminas.

In accordance with FIG. 2, the laminas 4 are developed as single-arm levers and are pivotally supported on a common shaft 7. The shaft 7 which forms the pivot axis of the laminas 4 extends in the filling direction over the entire width of the loom. The free end of the laminas 4 engages between the warp threads 1 and serves to drive the shuttles and for the beating up of the filling. At a distance of about one-third of the length of the laminas 4 from their pivot axis, the upper and lower edges of the laminas are developed as contact parts 16, 16' against each of which contact parts a separate flexible coupling body 10 and 10' respectively rests.

The coupling bodies 10, 10' which extend over the entire width of the undulating-shed loom are guided in corresponding recesses on the one end of the double-armed levers 11 and 11' respectively serving as drive means for the laminas 4. The levers 11, 11' which are arranged close together over the width of the loom are each pivotally supported around a separate shaft 12 and 12' respectively, arranged parallel to the shaft 7, and each of them is coupled in force locked manner at its other end with separate eccentric drive member 13 and 13' respectively. The eccentric drive members can be formed, for instance, by a screw shaft means or, as indicated in the figure, by eccentric disks arranged alongside of each other on a common drive shaft 14.

The axis of the shaft 12 which forms the pivot axis of the levers 11 lies in the extension of the straight line defined by the axis of the shaft 7 and the contact surface between contact part 16 and coupling body 10 in the central swing position of the laminas 4. The same applies with respect to the position of the axis of the shaft 12' with respect to the axis of the shaft 7 and the contact surface between contact part 16' and coupling body 10'. By this mutual position of the said parts, the result is obtained that there are practically no relative movements between the coupling bodies and the contact part of the corresponding laminas.

The laminas 4 and the parts driving them are mounted on a support plate 15 connected with the machine frame and are covered by a cover plate 31.

Figure 3:
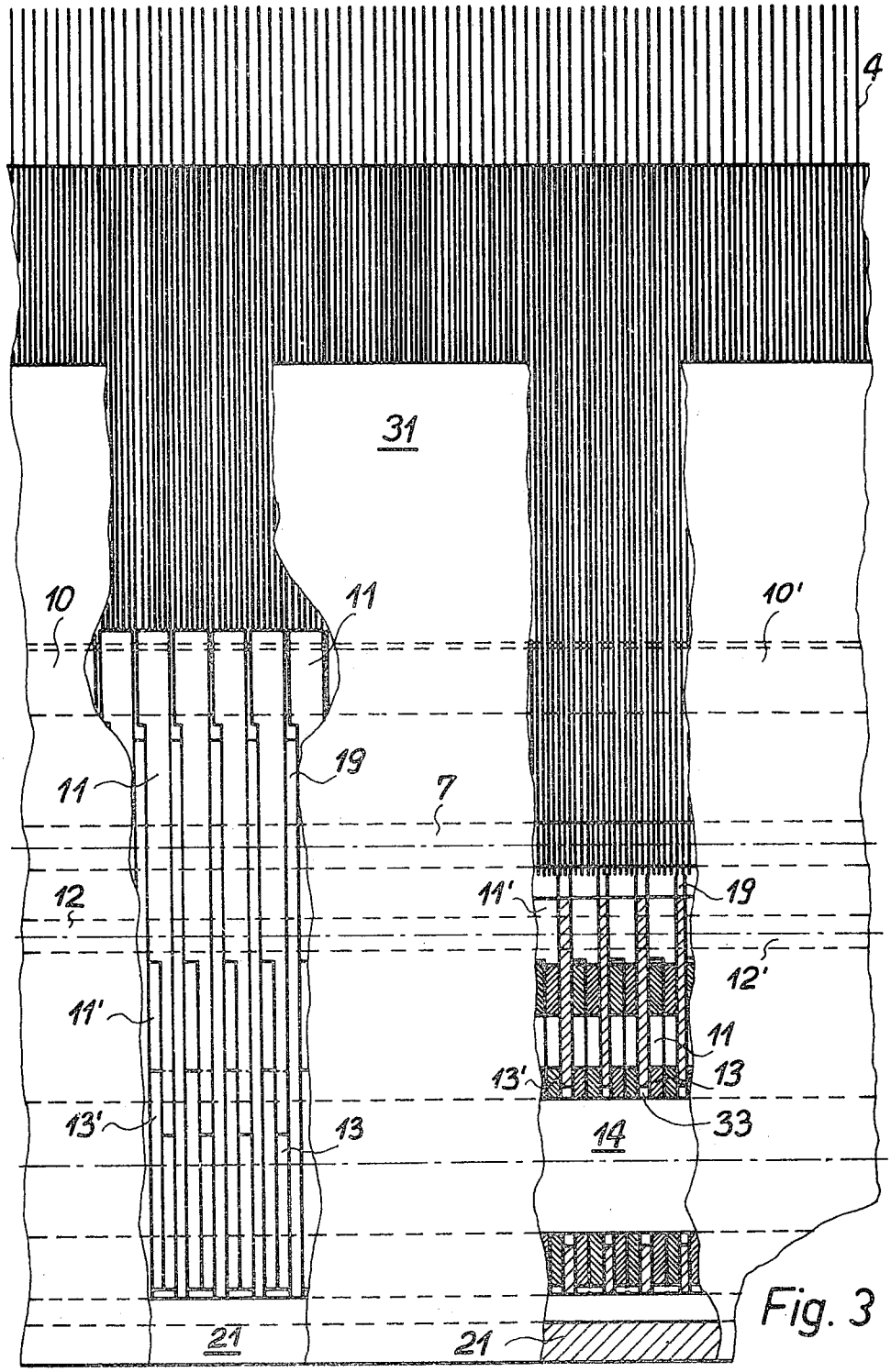
FIG. 3 shows a view seen in the direction of arrow B in FIG. 2, in partial section.

Referring to FIG. 3, which is a view seen in the direction of the arrow B in FIG. 2, the left-hand side of the figure being a view with the cover plate 31 removed (FIG. 2) and the right-hand side of the figure being a section along the line C—C of FIG. 2, the width of the levers 11, 11' at the end thereof acting on the coupling body 10, 10' is a multiple of the thickness of one lamina 4. The ratio of the width of the levers 11, 11' to the thickness of the laminas 4 is equal to about 10:1 to 20:1. In actual practice a lever width of about 7 mm. has been found particularly favorable; the thickness of the laminas 4 is about 0.4 mm. The width of the levers 11, 11' decreases in two steps to about one-third of the original width from the end thereof acting on the coupling bodies 10, 10' to the end thereof resting against the eccentric disks 13, 13'. The width of each eccentric disk 13, 13' and of the end of the levers 11, 11' resting against same is thus in each case about 2.5 mm. Compared with the known screw shaft in which laminas of a thickness of 0.4 mm. are also used, the contact surface between eccentric disk and lever to which the forces occurring upon the beating up of the thread are imparted, is about six times greater; accordingly, the wear of the eccentric disks is reduced as compared with the wear of the screw shaft.

In FIGS. 2 and 3 for the sake of clarity the levers 11, 11', the coupling bodies 10, 10', and the laminas 4 are in each case shown in their central position of swing; one lamina in the position of swing for the beating up of the filling thread and one lamina in the position of swing at greatest distance from the fabric beating-up edge are shown in dot-dash line in FIG. 2.

FIG. 4 shows in a basic sketch how the coupling bodies 10, 10' when the system is in operation transmit the movement of the levers 11, 11' to the laminas 4. The view shown in the figure corresponds approximately to the view from the tip of the laminas 4 looking at the levers 11, 11'.

In accordance with FIG. 4, the ends of the levers 11, 11' acting on the coupling bodies 10, 10' each forms a step shaped curve. The coupling bodies 10, 10' adjust themselves to the corresponding step shaped curve and thereby form a continuous undulation so that the laminas 4 borne by the coupling bodies also form a continuous undulation. In the sections of this undulation extending parallel to the direction of the filling thread and in particular in the thread beating-up position of the laminas 4, the coupling bodies 10, 10' rest snugly against the levers 11, 11' whereby a straight beating-up edge is made possible.

Since on the other hand the channel enclosed by the two coupling bodies 10, 10' must always be the same width due to the constant distance between the contact surfaces 16, 16' (FIG. 2) of the laminas 4 and since on the other hand the effective thickness d' of the coupling bodies 10, 10' is greater in regions in which the undulation does not extend parallel to the direction of the filling thread than their actual thickness d, the eccentric disks 13, 13' must be so shaped that they compensate for these differences in the effective thickness of the coupling bodies 10, 10'.

The coupling bodies 10, 10' which consist of an adequately flexible and sufficiently hard material, for instance of rubber or plastic, and have a rectangular cross-section as shown in the drawing need not consist of a single material over their entire cross-section. They can for example consist also of a core and of a jacketing surrounding it, in which case the core may be made of polyvinyl chloride (PVC) or of stranded wire and the jacketing of a suitable rubber material or of plastic. The coupling bodies 10, 10' may also have a laminate structure and consist of a plurality of layers or possibly different materials arranged parallel to each other in the longitudinal direction of the coupling bodies.

Material, shape, and construction of the coupling bodies 10, 10' must be such as to assure the best possible force-lock coupling between the levers 11, 11' and the laminas 4 and as to produce for the movement of the laminas 4 the shape of undulation shown in FIG. 1 as accurately as possible and in a manner which is reproducible the greatest possible number of times.

The construction of a complete drive system will now be described with reference to FIGS. 2 and 3:

The laminas 4 and the parts driving them are mounted on the support plate 15. This support plate is provided with first guide elements 26 for guiding the laminas 4 and with second guide elements 19 for guiding the levers 11, 11', the first guide element 26 being arranged between every two adjacent laminas 4 and a second guide element 19 being arranged between every two adjacent pairs of levers 11, 11'.

The first guide elements 26 are formed by flat thin parts of sheet metal or plastic arranged parallel to each other which space the laminas 4 the desired distance apart and furthermore protect them against lateral bending. By means of rods 17 which pass transversely through the first guide elements 26 and by means of spacer elements (not shown) arranged between adjacent first guide elements 26 as well as by threads provided at the ends of rod 17, the first guide elements 26 are connected together to form a firm package.

The first guide elements 26 each has a three T-shaped recesses 28 as well as a finger-shaped extension. In the cross-bars of the recesses 28 rails 27 having threaded bore holes are supported. By means of screws 29 screwed through the base plate 15 and into the rails 17 the package formed by the first guide elements 26 is screwed firmly to the base plate 15 and to the cover plate 31. In the finger-shaped extension of the first guide elements 26 there is arranged a bore hole in which the shaft 7 forming the pivot axis of the laminas 4 is supported.

The second guide elements 19 are formed by flat thin parts of sheet metal or plastic arranged parallel to each other which hold the pairs of levers 11, 11' apart with the desired spacing. By rods 20 extended transversely through the second guide elements 19 and by spacer elements (not shown) arranged between adjacent second guide elements 19 as well as by threads provided on the ends of the rods 20, the second guide elements 19 are also connected together to form a rigid package. This package is connected with the support plate 15, with the cover plate 31, and with a rear wall 21 fastened via screws 32 to the support plate 15 by means of screw fastenings 22, 23, and 24 in the same manner as the screw fastenings 27, 28, and 29 of the first guide elements 26.

The second guide elements 19 are provided on the side thereof facing the shed with a recess which forms the counterpiece to the finger-shaped extension of the first guide elements 26. Furthermore, in each of the second guide elements 19 there are bore holes for the supporting of the shafts 12, 12' and 14, the supporting of the shaft 14 being effected by bearing rings 33. The eccentric disks 13, 13' are connected to the shaft 14 by keys.

Figure 5:
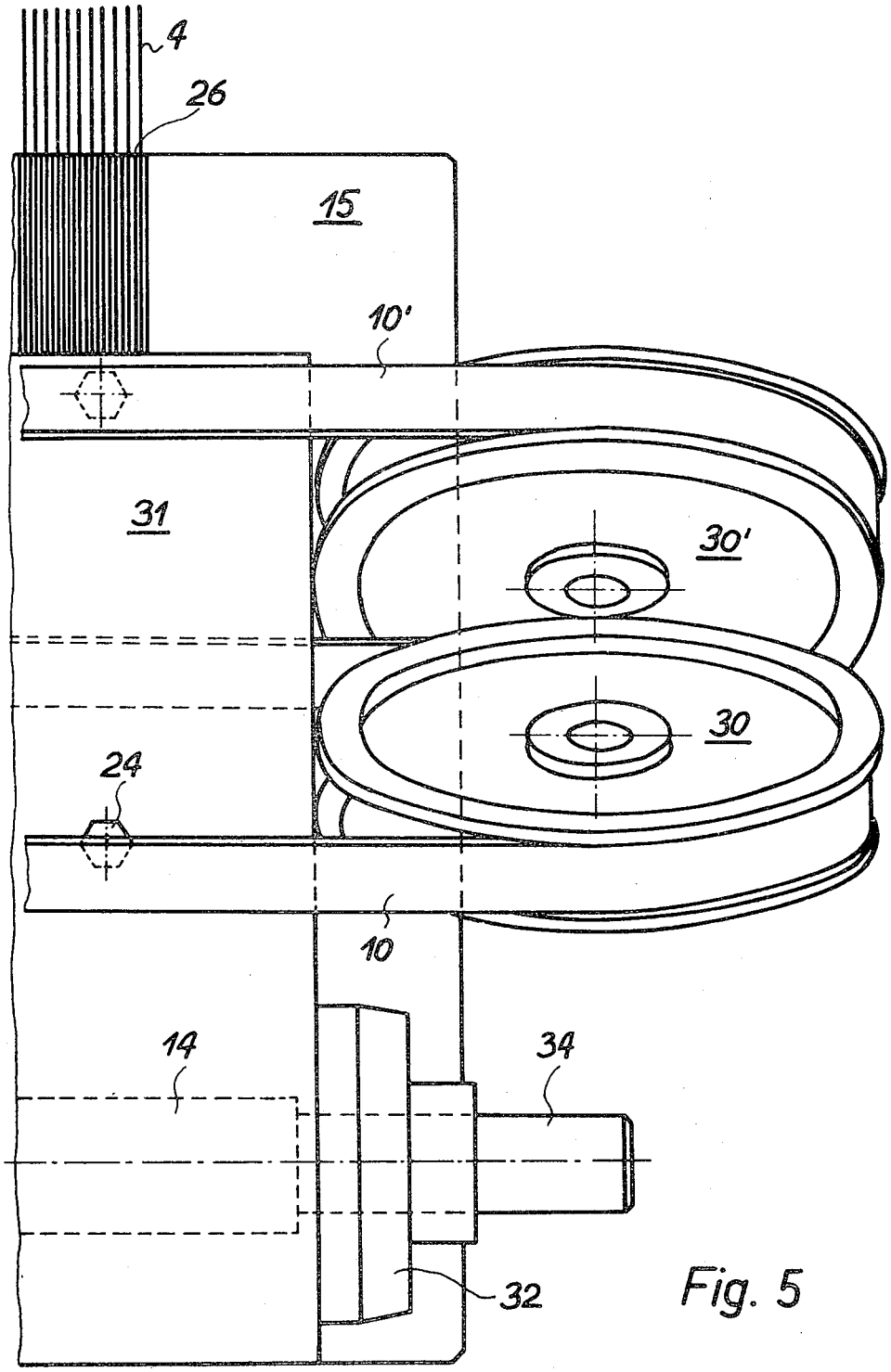
FIG. 5 is a second view seen in the direction of the arrow B in FIG. 2.

FIG. 5 shows a view, seen in the direction of the arrow B of FIG. 2, of one of the side ends of a drive arrangement in accordance with the invention. The second side end (not shown) is a mirror image of that shown in the figure.

In accordance with FIG. 5, each of the two coupling bodies 10, 10' is developed as an endless belt and each of them is conducted over a pair of pulleys or rollers 30, 30'. The pulleys or rollers 30, 30' are rotatably supported on both sides of the drive system on bearing arms (not shown) which are rigidly connected with the support plate 15. The development of the coupling bodies as an endless belt has proven advantageous since the propagation of the wave formed by the laminas takes place always only in one direction, as a result of which the coupling bodies 10, 10' also have a tendency to move in this direction. The additional wear of the coupling bodies resulting therefrom in the event of a rigid mounting of the coupling bodies is avoided by the development described.

Of course, the coupling bodies 10, 10' can also be developed as a normal elongated belt and be mounted firmly and indisplaceably in the system. In this case, however, the aforementioned additional wear would have to be tolerated.

As can be noted further from FIG. 5, a bearing pedestal 32 is arranged on the base plate 15 at both side ends for the supporting of the drive shaft 14. At its end 34 which extends freely out of one of the bearing pedestals 32 the drive shaft 14 is coupled with a drive, not shown. The bearing pedestals 32 need not be necessarily provided; the supporting of the drive shaft 14 in the second guide elements 19 may also be sufficient.

In accordance with FIG. 6, the laminas 4 can also be developed as double-armed levers. The two lever arms are designated 8 and 9. In this embodiment only one coupling body 10 is used which is connected with the associated cam disks 13 by means of swing levers 11.

By means not shown in the drawing, for instance suitable springs, swing levers 11 and associated eccentric disks 13 are kept in force-locked contact with each other.

The lever 11 is developed as bell crank lever swingably supported on the shaft 12. The coupling body 10 has, as shown in the drawing, a U-shaped cross-section and is supported with its outer surface rotatable about its longitudinal axis in a recess at the one end of the bell crank lever 11. The laminas 4 are held by the inner part of the coupling body 10.

For the assembling of the laminas 4 and the parts driving them, what was stated in FIGS. 2 to 5 applies with slight modifications also to this embodiment and the embodiment shown in FIG. 7. Since these modifications are within the comprehension of the man skilled in the art, they are not described in detail here.

In accordance with FIG. 7, the flexible coupling body 10 has a rectangular cross-section and is fitted on its narrow sides in recesses on one end of the swivel lever 11 and on one end of the laminas 4. The drive unit of the laminas 4— shaft 14 with eccentric disks 13 and shaft 12 with swing lever 11—is arranged in an oil bath surrounded by a liquid-tight container 35 in order to reduce frictional forces between eccentric disks and bell crank lever.

It will be appreciated that various changes and modifications may be made within the skill of the art without departing from the spirit and scope of the invention illustrated, described, and claimed herein.

What is claimed is:

1. Arrangement for the actuating of laminas on an undulating-shed-type weaving machine, said laminas:

a. acting as filling-thread beat-up members and in operation carrying out in their entirety an undulating movement in the direction advancing over the width of the machine;

b. being arranged along a pivot axis over the width of the machine and being adapted to be pivoted about said axis by means of drive cams;

c. being formed as single-armed levers having a contact surface at their top and at their bottom edges as referred to their direction of swing about their axis of pivot and being held at said contact surfaces by a separate coupling body of flexible material in each case, each of said coupling bodies extending over the entire width of the machine; and d. being actuated by drive means arranged close together over the width of the machine and being coupled with said drive cams, and drive means acting on the coupling bodies and having at the part acting on the coupling bodies a width being several times the thickness of a lamina.

2. The arrangement according to claim 1 in which a separate group of drive means is acting on the two coupling bodies, one drive means of the one group being arranged alongside one drive means of the other group over the width of the machine, said drive means being formed by double-arm pivoted levers whose one arm rests against the corresponding drive cam while its other arm is acting on the corresponding coupling body.

3. The arrangement according to claim 2 in which the width of the drive means on the part thereof acting on the corresponding coupling body is from about ten to about twenty times the thickness of a lamina.

4. The arrangement according to claim 2 in which the width of the said drive means at the part thereof coupled with the corresponding drive cam is about one-third of the width of the part thereof acting on the corresponding coupling body.

5. The arrangement according to claim 2 in which each of the two groups of drive means is supported on a separate shaft arranged parallel to the pivot axis of the laminas.

6. The arrangement according to claim 5 in which the said separate shafts are so arranged that their axis in the position, defined by the central position of the swing of the laminas and thus of the said drive means, of the surface of the flexible coupling bodies resting against the contact surfaces of the laminas lies on the extension of the straight line determined by the pivot axis of the laminas and by the said surface of the associated coupling body.

7. The arrangement according to claim 2 in which the coupling bodies have a homogeneous cross-section.

8. The arrangement according to claim 2 in which the coupling bodies are constructed with respect to their cross-section of a plurality of layers which are firmly connected together.

9. The arrangement according to claim 2 in which the coupling bodies are constructed with respect to their cross-section of a core having a jacketing surrounding it.

10. The arrangement according to claim 1 in which each coupling body has the shape of an endless band and is guided over a pair of rollers rotatably supported on both sides of said actuating arrangement.

11. Arrangement for the actuating of laminas on an undulating-shed-type weaving machine, said laminas:

a. acting as filling-thread beat-up members and in operation carrying out in their entirety an undulating movement in the direction advancing over the width of the machine;

b. being arranged along a pivot axis over the width of the machine and being adapted to be pivoted about said axis by means of drive cams;

c. being formed as double-armed levers and being held, by their arms that face away from the shed, by a coupling body of flexible material, said coupling body extending over the entire width of the machine; and d. being actuated by drive means arranged close together over the width of the machine and being coupled with said drive cams, said drive means acting on the coupling body and having at the part acting on the coupling body a width being several times the thickness of a lamina.

12. The arrangement according to claim 11 in which the drive cams are each formed by an eccentric disk associated with each of said drive means, said eccentric disks being mounted on a common drive shaft which is arranged in a container which contains a lubricating liquid.

13. The arrangement according to claim 11 in which the coupling body has a U-shaped cross-section and with its inner part bears on the laminas and is rotatably supported about its longitudinal direction with its outer part on the drive means.

14. The arrangement according to claims 11 in which the coupling body has a rectangular cross-section with one narrow side coupled to the laminas and the other narrow side coupled to the drive means.

* * * * *